United States Patent [19]

Zwimpfer

[11] Patent Number: 5,041,074

[45] Date of Patent: Aug. 20, 1991

[54] FOLDING MACHINE, ESPECIALLY UPSET-FOLDING MACHINE

[75] Inventor: Joseph Zwimpfer, Zofingen, Switzerland

[73] Assignee: Jos. Hunkeler, Ltd., Wikon, Switzerland

[21] Appl. No.: 421,135

[22] Filed: Oct. 13, 1989

[30] Foreign Application Priority Data

Oct. 14, 1988 [DE] Fed. Rep. of Germany ..... 3835124

[51] Int. Cl.[5] ..... B65H 45/14

[52] U.S. Cl. ..... 493/420; 493/421

[58] Field of Search ..... 493/249, 419, 420, 421

[56] References Cited

U.S. PATENT DOCUMENTS

| | | | |
|---|---|---|---|
| 1,803,370 | 5/1931 | Tufts | 493/419 |
| 2,253,446 | 8/1941 | Spiess | 493/420 |
| 2,997,295 | 8/1961 | Beck | 493/420 |
| 4,402,679 | 9/1983 | Heina | 493/420 |
| 4,512,845 | 1/1985 | Kobler . | |

FOREIGN PATENT DOCUMENTS

| | | | |
|---|---|---|---|
| 0171753 | 2/1986 | European Pat. Off. . | |
| 555945 | 7/1932 | Fed. Rep. of Germany | 493/420 |
| 1228278 | 11/1966 | Fed. Rep. of Germany . | |
| 1961479 | 10/1970 | Fed. Rep. of Germany . | |
| 90802 | 6/1972 | Fed. Rep. of Germany . | |
| 2253574 | 5/1974 | Fed. Rep. of Germany . | |

*Primary Examiner*—Frederick R. Schmidt
*Assistant Examiner*—Jack W. Lavinder
*Attorney, Agent, or Firm*—Davis Hoxie Faithfull & Hapgood

[57] ABSTRACT

A folding machine for processing printed sheets has a folding pocket into which sheets are fed by a pair of rollers. The infeed of the folding pocket has a guide plate and a guide device between which sheets are guidingly fed into the pocket. The guide device consists of a succession of several profiled segments releasibly secured to a carrier, preferably slidingly mounted in a groove in a carrier by means of clamping screws. The profiled segments may be spaced from one another so as not to contact adhesive strips on the sheets. Because guide device consists of several segments, the spaces between segments can easily be varied to match sheets having different formats of adhesive strips.

7 Claims, 3 Drawing Sheets

FOLDING MACHINE, ESPECIALLY UPSET-FOLDING MACHINE

The present invention relates to a folding machine, especially an upset-folding machine, for the processing of printed sheets, according to the preamble of claim 1.

In such folding machines, such as are known, for example, from EP-A20,171,753, in the region of the infeed to the folding pocket there is usually a guide section extending at right angles to the direction of movement of the sheets, in order to introduce the supplied sheets into the folding pocket and in order, during the upsetting of the sheets, to obtain the desired bending. Now it often happens, especially in the production of letter forms, that the sheets are given adhesive coatings extending in the direction of movement and located on the side facing the guide section. To avoid bringing the guide section in contact with the adhesive, it is equipped, in the region of the respective adhesive coatings, with grooves which are worked into the guide profile by milling, sawing or grinding. This makes it necessary, whenever the sheet format to be processed is changed, either to replace the guide section with another suitably matched guide section or to make new grooves on the guide section. Consequently, either keeping an appropriate number of different guide sections in stock or matching the guide section each time are required, although the latter, after a certain number of grooves have been worked into the guide section entails the need to replace the guide section by a new one.

The object of the present invention is, therefore, to provide a folding machine, especially an upset-folding machine for printed sheets having a folding pocket and a profiled guide device at the pocket infeed and extending essentially at right angles to the direction of movement of sheets, which no longer has these disadvantages and which, without a high outlay in terms of labor, can be matched to the new sheet format to be processed.

This object is achieved by means of the features of the guide device according to this invention, which guide device possesses a number of individual profiled segments fastened releasably to a carrier element, which segments are variable in position in the longitudinal direction of the guide device and are arranged in succession. Because there are individual segments which are fastened releasably to the carrier element, it is now possible to arrange these segments in the desired positions on the carrier element, thus making it possible to match the guide device extremely simply to the format of the printed sheets to be processed.

Figure 1:
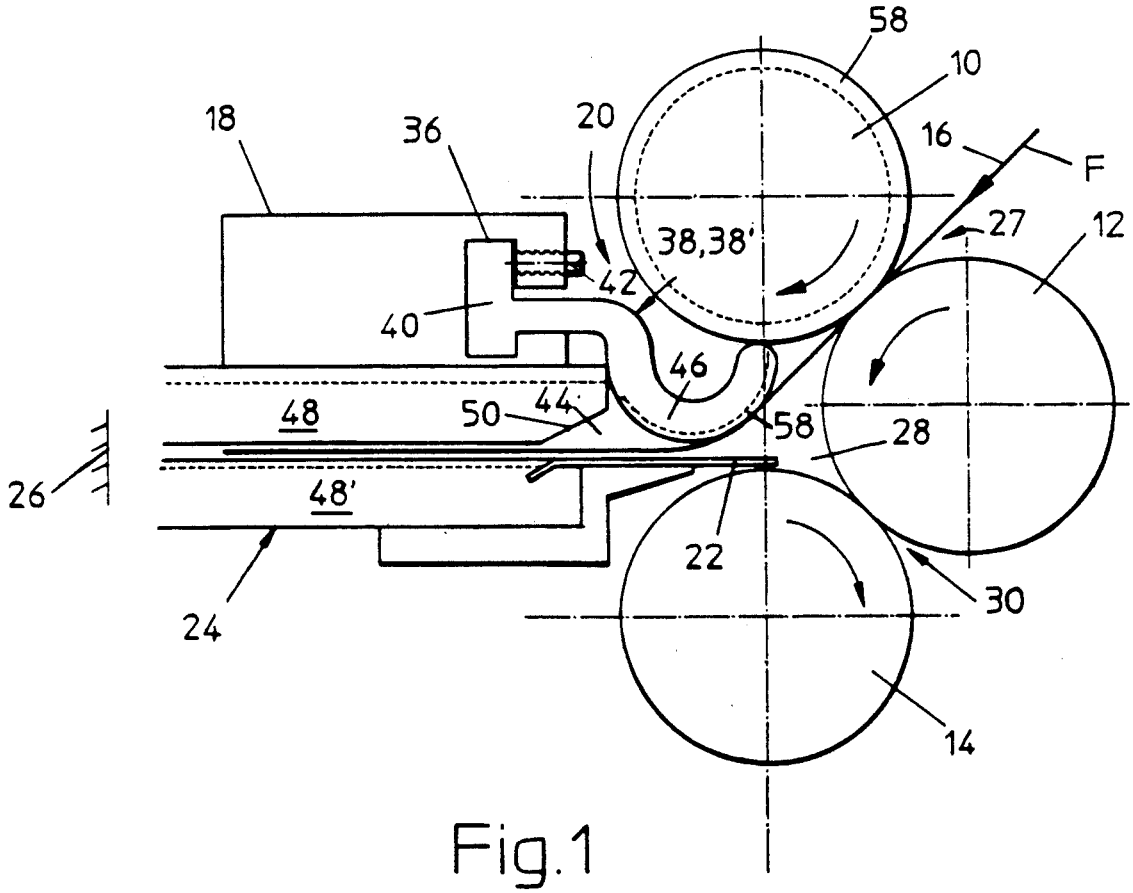
Figure 2:
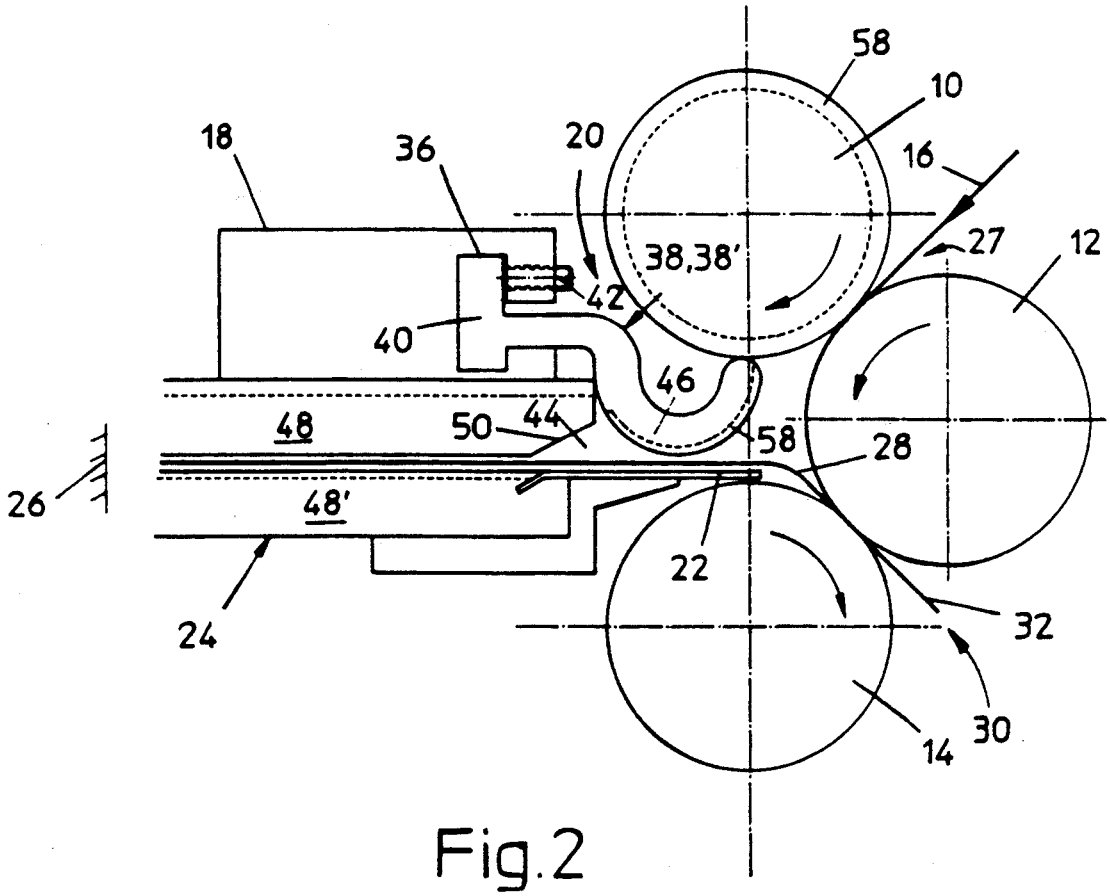
Figure 3:
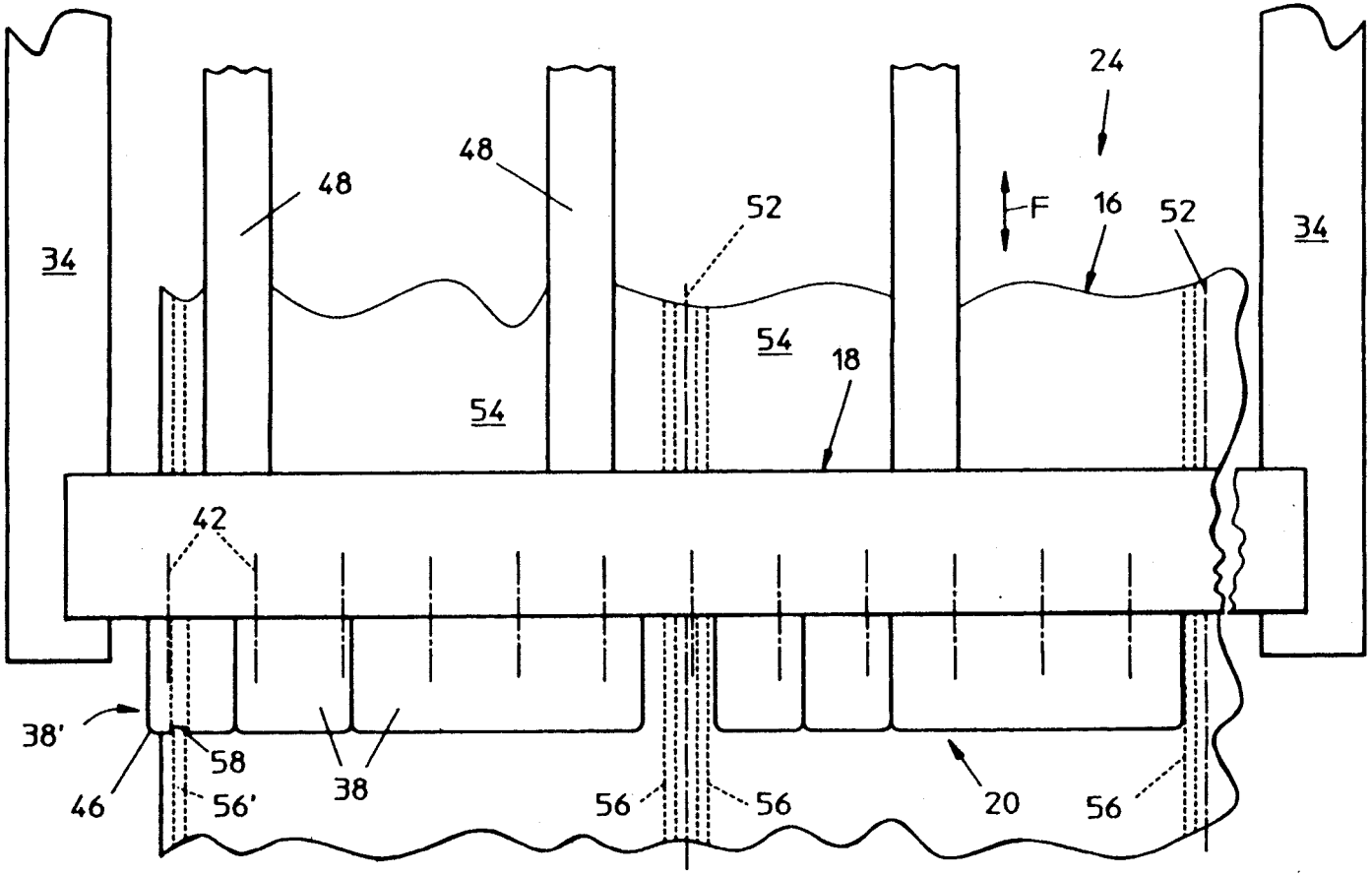

Preferred embodiments of the invention are described in detail below with reference to an exemplary embodiment illustrated in the Figures. Of the purely diagrammatic Figures:

FIGS. 1 and 2 show a simplified side view of part of an upset-folding machine at different processing stages, and FIG. 3 shows a truncated top view of part of the folding pocket with the guide device.

The upset-folding machine illustrated has three folding rollers 10, 12, 14 which respectively form, in twos, pairs of rollers 10, 12 and 12, 14 driven in mutual opposition in the direction of the arrows. For the sake of greater clarity, these three folding rollers 10, 12, 14 are not shown in FIG. 3. The upper pair of rollers 10, 12 defines a path extending above the pair of rollers 12, 14 and intended for a sheet 16 to be introduced into the upset-folding machine (see FIG. 1). This path leads underneath a guide device 20 fastened to a carrier 18 and above a guide plate 22 into a folding pocket 24 with an adjustable stop 26 merely indicated diagrammatically.

The sheet 16 to be folded is fed from a transport arrangement not shown, in the direction of the arrow F, to the oppositely driven first pair of rollers 10, 12, is drawn into its nip 27 and is guided through under the guide device 20 and over the guide plate 22 into the folding pocket 24 as far as the stop 26 (FIG. 1). The sheet 16 which continues to be pushed forward by the pair of rollers 10, 12 is bulged out towards the entry region 28 of the nip 30 of the lower pair of rollers 12, 14 and is driven into the nip 30, at the same time forming a fold 32. The sheet 16 thus grasped in the region of the fold 32 by the lower pair of rollers 12, 14 is conveyed through the nip 30 to a subsequent station (see FIG. 2). This can be a further folding device which works on the principle described and in which the sheet already folded once is given a further fold.

As is evident especially from FIG. 3, the carrier 18 of rectangular cross-section extends over the entire width of the folding pocket 24 in a direction at right angles to the direction of movement F of the sheet 16 and is held at both ends by carrier elements 34. These carrier elements 34 are not shown in FIGS. 1 and 2 for the sake of greater clarity. On the side facing the upper pair of rollers 10, 12, the carrier 18 has a T-shaped groove 36. The guide device 20 consists of a number of profiled segments 38, 38', on which are formed T-shaped wedges 40, by means of which the segments 38 are guided in the T-shaped groove 36 of the carrier 18 (see especially FIGS. 1 and 2). Along the T-shaped groove 36, a number of clamping screws 42 are screwed into the carrier 18 at regular intervals, as represented by dot-and-dash lines in FIG. 3. These, in the region of the T-shaped wedged 40 of the segments 38, come to bear on the latter and clamp them firmly. The segments 38 project toward the pair of rollers 10, 12 beyond the carrier 18 and the infeed, designated by 44, of the folding pocket 24 and in this region have a concavely formed guide tongue 46 directed towards the guide plate 22.

Also fastened to the carrier 18 are profile strips 48 which limit the folding pocket 24 on the upper side and extend in the direction of movement F of the sheets 16 and which have a bevel 50 in the region of the infeed 44, to allow the sheet 16 to run easily into the folding pocket 24. The folding pocket 24 is limited on the lower side by further profile strips 48'.

As emerges from FIG. 3, the sheet 16 (shown only partially) introduced into the folding pocket 24 is subdivided into several sheet parts 54 by means of perforations 52 represented by dot-and-dash lines. These perforations 52 extend parallel to the direction of movement F of the sheet 16 represented by the double arrow. Each sheet part 54 possesses, on each of its two lateral edge regions, an adhesive strip 56 represented by broken lines. These adhesive strips 56 are located on that side of the sheet 16 facing the guide device 20.

The segment 38', shown on the far left in FIG. 3 possesses, in the region of the adhesive strip 56', on that side of the guide tongue 46 facing the sheet 16 a groove 58, the width of which is larger than the width of the adhesive strip 56'. A corresponding segment 38' can be provided in the region of the right-hand edge of the sheet 16 not shown in FIG. 3.

In the region of the perforations 52 and of the adhesive strips 56 provided at these, the segments 38 are spaced from one another so that none of the segments 38 comes in contact with the adhesive strips 56. The segments 38 have partially differing lengths, as seen in the longitudinal direction of the carrier 18. This makes it possible, by the shift or exchange of segments 38 and 38', to match the guide device 20 easily to the different formats of the sheets 16 or sheet parts 54 supplied. A large number of sheets 16 of different formats can therefore be processed with a limited number of segments 38, 38'.

It may be mentioned, in conclusion, that in the region of the adhesive strips 56 the folding roller 10 has peripheral recesses 58, so as not to come in contact with the adhesive.

The sheets 16 or sheet parts 54 folded in this way and, after passing through the pair of folding rollers 12, 14, glued together along the adhesive strips 56, 56'often form finished letter forms ready for dispatch.

I claim:

1. An upset folding machine for folding printed sheets comprising a. a folding pocket having an infeed opening for said sheets;

b. feed means for feeding said sheets sequentially through said infeed opening into said folding pocket;

c. a carrier element extending across said pocket parallel to said infeed opening;

d. means for guiding said sheets into said infeed opening, said guide means including a profiled guide device extending across said infeed opening, said device comprising at least several individual profiled segments arranged in succession across said infeed opening; and e. securing means for releasably securing said individual profiled segments to said carrier element, whereby said at least several individual profiled segments can be arranged with at least one gap between successive segments, the location of said gap being variable with the arrangement of said segments.

2. A folding machine according to claim 1 wherein said carrier element includes a receiving groove extending parallel to said infeed opening and wherein said individual profiled segments include wedge means slidably located in said groove.

3. A folding machine according to claim 2 wherein said securing means comprises clamping means on said carrier.

4. A folding machine according to claim 3 wherein said clamping means includes at least several clamping screws which can be brought to bear on the wedges of individual profiled segments slidably located in said grove.

5. A folding machine according to claim 7 wherein said individual profiled segments include segments differing in width.

6. A folding machine according to claim 5 wherein the outermost segments comprising said guide device are grooved to prevent contact with said sheets.

7. A folding machine according to claim 7 wherein the outermost segments comprising said guide devices are grooved to prevent contact with said sheets.

* * * * *